US005390464A

United States Patent [19]

West

[11] Patent Number: 5,390,464

[45] Date of Patent: Feb. 21, 1995

[54] METHOD OF FORMING A CONCRETE COLUMN CAPITAL IN A STANDARD FLAT PLATE CONCRETE SLAB

[76] Inventor: Mark West, 312 Kirchoffer Avenue, Ottawa, Ontario R2A 1Y3, Canada

[21] Appl. No.: 169,368

[22] Filed: Dec. 20, 1993

Related U.S. Application Data

[63] Continuation-in-part of Ser. No. 946,676, Aug. 18, 1992.

[51] Int. Cl.[6] ..... Ê04G 21/00

[52] U.S. Cl. ..... 52/741.1; 52/745.17; 264/32; 249/26

[58] Field of Search ..... 264/31, 33, 31.3; 249/26, 48, 49; 52/250, 263, 647.2, 648.4, 745.17, 741.1

[56] References Cited

U.S. PATENT DOCUMENTS

| | | | |
|---|---|---|---|
| 619,769 | 2/1899 | Lilienthal | 52/335 |
| 914,861 | 3/1909 | Muldoon | 52/649.2 |
| 1,008,209 | 11/1911 | Skinner | 52/649.4 |
| 1,143,107 | 6/1915 | Deslauriers | 249/26 |
| 1,241,945 | 10/1917 | Fletcher | 264/32 |
| 1,293,378 | 2/1919 | Donaldson | 52/250 |
| 1,301,561 | 4/1919 | Hirschthal | 249/27 |
| 1,307,179 | 6/1919 | Billner | 52/335 |
| 1,569,144 | 1/1926 | Scammell | 52/105 |
| 1,828,078 | 10/1931 | Sealey | 52/327 |
| 1,955,716 | 4/1934 | De Waller | 52/250 |
| 1,959,119 | 5/1934 | Young | 52/335 |
| 2,096,629 | 10/1937 | Farrar et al. | 264/34 |
| 3,383,816 | 5/1968 | Hodson | 52/335 |
| 3,619,959 | 11/1971 | Parker | 52/235 |
| 4,505,087 | 3/1985 | Sarda | 264/31 |

FOREIGN PATENT DOCUMENTS

| | | | |
|---|---|---|---|
| 382610 | 10/1932 | United Kingdom | 52/335 |

*Primary Examiner*—James L. Ridgill, Jr.
*Attorney, Agent, or Firm*—Frederick R. Cantor

[57] ABSTRACT

A method of forming a concrete column capital using a flexible tension membrane material in place of the traditional rigid panels currently used for this purpose, is described. A flexible tension membrane material is attached to an opening in a panelized flat slab formwork deck located directly above a pre-existing concrete column. The membrane forms a bag-like container which contains and supports the wet concrete, and serves to form a column capital between the column and the flat slab above. Also disclosed are methods for anchoring the flexible tension membrane capital form to a panelized flat slab formwork deck.

9 Claims, 2 Drawing Sheets

METHOD OF FORMING A CONCRETE COLUMN CAPITAL IN A STANDARD FLAT PLATE CONCRETE SLAB

CROSS REFERENCE TO RELATED PATENT APPLICATION

This is a continuation-in-part of my copending patent application Ser. No. 07/946,676, filed on Aug. 18, 1992.

BACKGROUND OF THE PRESENT INVENTION

The present invention relates to a new method of forming a concrete column capital within the traditional panelized formwork currently used to form reinforced concrete flat slabs.

The present invention, more particularly, relates to a method of forming a concrete column capital, wherein the formwork containing and shaping the wet concrete, comprises one or more flat flexible sheets, e.g., a woven, coated or uncoated, high density polyethylene, or polypropylene fabric.

The floors of reinforced concrete buildings are sometimes formed without beams that project below the undersurface of the slab. This type of reinforced concrete slab is sometimes referred to as a "flat plate slab", because the underside of the slab is uninterrupted by supporting beams. These slabs have the advantage of being faster and easier to form, and their flat undersurfaces do not restrict, or complicate, the later installation of partition walls, ductwork, plumbing, etc., within the completed building.

Because flat plate slabs rest directly on top of the columns which support them, without the added depth of any supporting beams, they are particularly vulnerable to punching shear stresses at the column-slab junction. Sometimes a flat slab cannot provide sufficient resistance to the shear forces imposed on it by a supporting column. Under these conditions a column capital is formed between the supporting column and the flat slab it supports. This column capital provides a deeper section to the area of the flat slab near the supporting column, thus providing the added strength necessary to resist the concentrated sheer stresses that develop around a supporting column.

There are several different conventional methods of forming a concrete column capital. However, these conventional methods usually use some kind of rigid formwork material, e.g., plywood or metal panels, fiberglass reinforced moulds, etc.

Often, a single building may have several different sizes of columns, and the distance between support columns may vary considerably. Under these conditions, several different column capital forms may have to be constructed for a single building. These column capital formworks are often constructed so that they can be disassembled and removed for possible use at a different location in the building, or a different job site. The construction, removal, and re-assembly of rigid column capital forms is often not easily accomplished. These tasks involve the cutting and assembling of several different rigid pieces. In addition, conventional column capital formwork often requires a more complex shoring framework to be built below the flat slab formwork panels than would otherwise be required.

The use of a flexible tension membrane formwork to form a concrete column capital would substantially simplify many of these difficulties. Column capital formworks could be constructed out of fewer pieces, using a flexible fabric; the removal and re-assembly of capital formworks would likewise be simplified. The material costs of a fabric formwork would be many times less than even the least expensive rigid formwork material. The geometry of a column capital formed with a flexible tension membrane would be more efficient than those typically formed with plywood panels, and hence require less concrete. A flexible tension membrane formwork would obviate the requirement for the more complex shoring framework that is usually built below the flat slab formwork panels in conventional practice.

SUMMARY OF THE PRESENT INVENTION

The present invention relates to a method of forming a concrete capital connecting a flat reinforced concrete slab with a pre-existing support column, using flexible sheet material as the formwork for the concrete capital.

In one particular method embodying the present invention, a flexible sheet is formed into a hollow frustum-shape, corresponding to the shape of the concrete capital that is to be formed between a concrete deck and a support column. Outer edge areas of the sheet are attached to rigid panels that form a compression ring sized to snugly fit within a relatively large opening in a flat slab formwork deck. The compression ring is placed into the deck opening, and the inner annular edge of the flexible sheet is clamped or otherwise attached to the vertical side surfaces of a pre-existing support column located directly below the deck opening.

The hollow frustum-shaped sheet forms a mold or formwork for a concrete capital that is to be formed between a poured concrete slab and the pre-existing column. Wet concrete is poured onto the formwork deck and the frustum-shaped sheet to form the concrete slab and capital in a one-step operation.

In addition to the frustum-shaped geometries specifically described herein, other simple or complex, symmetrical or asymmetrical frustum-like shapes can also be formed using the same principles. The different column capital designs that can be formed by this method will be determined by the geometry of the compression ring, and that of the flexible formwork sheet employed in each case.

A principal advantage of the method of this invention is that the flexible sheet is relatively cheap and easily formed into a hollow frustum configuration. Also, after the concrete capital has been formed, the flexible sheet can be readily stripped away from the concrete undersurface. Preferably the convergent frustum-shaped sheet is supported only at its outer edge (where it is attached to the formwork deck) and its inner edge (where it is attached to the pre-existing column); with this type of support the capital formwork requires a minimal amount of material, because it is acting as a pure tension membrane, requiring no further shoring or intermediate supports. This method also makes it relatively easy to separate the capital formwork from the concrete capital.

Because this method uses so little material, and because the fabrics which can be used are relatively inexpensive, the formwork described can also be left on the surface of the finished concrete member, thus making it a sacrificial formwork that offers savings in labor costs.

In summary, and in accordance with the above discussion, the foregoing objectives are achieved in the following embodiments.

1. A method of forming a concrete capital connecting a flat reinforced concrete slab with a pre-existing support column, comprising:

(a) providing a flat slab formwork deck that includes an opening directly above the column;

(b) supporting a flexible sheet from said formwork deck, such that said sheet is draped across said opening so as to encircle the outside surfaces of said column;

(c) attaching said sheet to the outside vertical surfaces of said column; and (d) pouring wet concrete onto said flat slab formwork deck and said flexible sheet, so as to form a concrete flat slab and column capital connected to the support column.

2. The method, as described in paragraph 1, wherein step (b) is performed with a sheet that has a hollow frustum configuration.

3. The method, as described in paragraph 1, wherein step (c) involves forming a reinforcement ring around portions of the flexible sheet engaged with the outside vertical surfaces of the column.

4. The method, as described in paragraph 1, wherein step (b) involves the sub-steps of providing a hemmed loop around the outer edges of the flexible sheet, forming a compression ring by inserting rigid ring material into the hemmed loop and attaching the compression ring to the flat formwork deck.

5. The method, as described in paragraph 4, wherein step (b) is carried out so that the compression ring is coplanar with the formwork deck.

6. The method, as described in paragraph 1, wherein step (b) involves forming a compression ring to fit within the opening in the formwork deck, and attaching edge areas of the flexible sheet to the compression ring.

7. The method, as described in paragraph 6, wherein step (b) is carried out so that the flexible sheet is attached to the compression ring before the compression ring is placed within the deck opening.

8. The method, as described in paragraph 1, wherein step (b) comprises forming the flexible sheet with four straight outer edges, providing a loop along each outer edge of the sheet, inserting rigid panels into said loops to form a continuous compression ring, and placing the ring-sheet assembly into the deck opening.

9. The method, as described in paragraph 8, wherein step (b) is performed with a flexible sheet that has a hollow frustum configuration.

10. A method of forming a concrete capital connecting a flat reinforced concrete slab with a pre-existing support column, comprising:

(a) providing a flat slab formwork deck that includes an opening directly above the pre-existing column;

(b) forming a flexible sheet into a hollow frustum configuration, in which the sheet has an outer edge area approximating the size of the deck opening and an inner edge area sized to fit around vertical side surfaces of the pre-existing column;

(c) forming a compression ring sized to fit snugly within the deck opening, and attaching said compression ring to outer edge areas of the flexible sheet;

(d) placing the compression ring and attached flexible sheet in the deck opening;

(e) clamping the inner edge area of the flexible sheet to side surfaces of the pre-existing column; and (f) pouring wet concrete onto the flat slab formwork and said flexible sheet so as to form a flat slab and column capital connected to the support column.

11. The method, as described in paragraph 10, wherein step (b) is performed with a single flat sheet.

12. The method, as described in paragraph 10, wherein step (b) involves the sub-step of tailoring the flexible sheet in such a manner that a reattachable joint is provided along a line between the outside surface of the column and the edge of the deck opening, thus producing a formwork capable of being removed from the finished concrete member and reassembled and reused to form another such concrete member.

A BRIEF DESCRIPTION OF THE DRAWINGS

DESCRIPTION OF THE PREFERRED EMBODIMENTS OF THE PRESENT INVENTION

Figure 1:
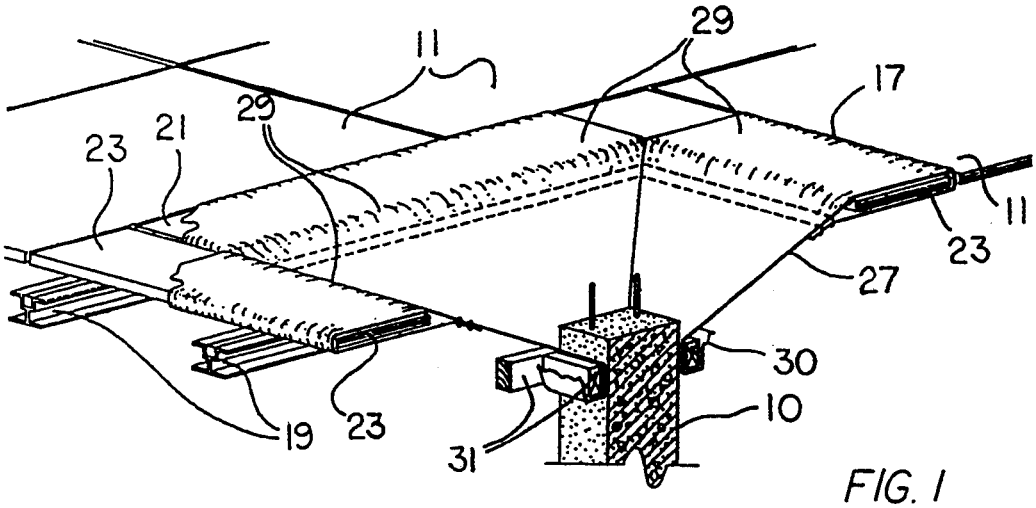
FIG. 1, is a fragmentary perspective view, looking down on a sheet-type formwork used to form a concrete capital connection between a concrete slab (or floor), and a pre-existing support column, using the method of the present invention.

FIG. 1, is a fragmentary perspective view, looking down on a sheet-type formwork used to form a concrete capital connection between a concrete slab (or floor), and a pre-existing support column, using the method of the present invention.

Figure 2:
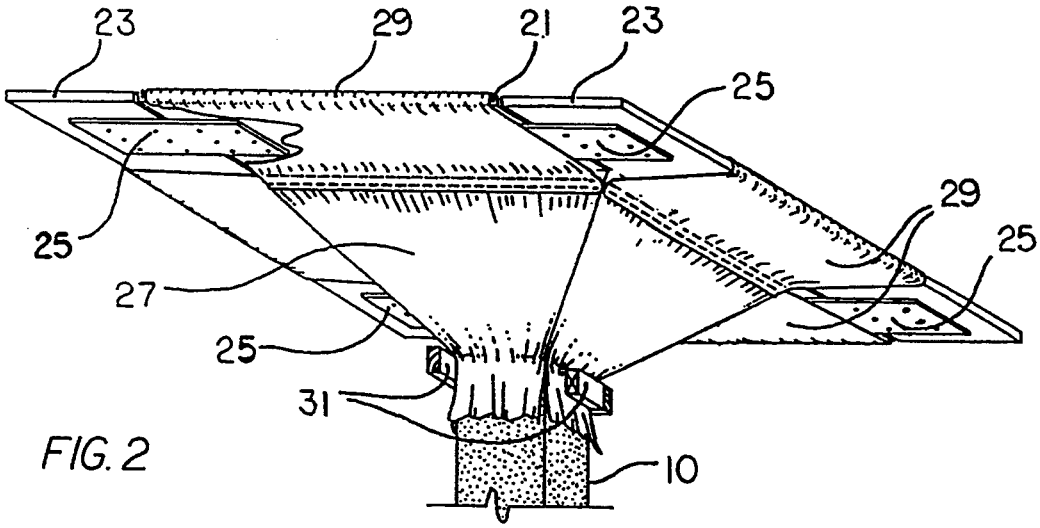
FIG. 2, is a fragmentary perspective view, of the FIG. 1 formwork, taken from a point below the formwork.

FIG. 2, is a fragmentary perspective view, of the FIG. 1 formwork, taken from a point below the formwork.

Figure 3:
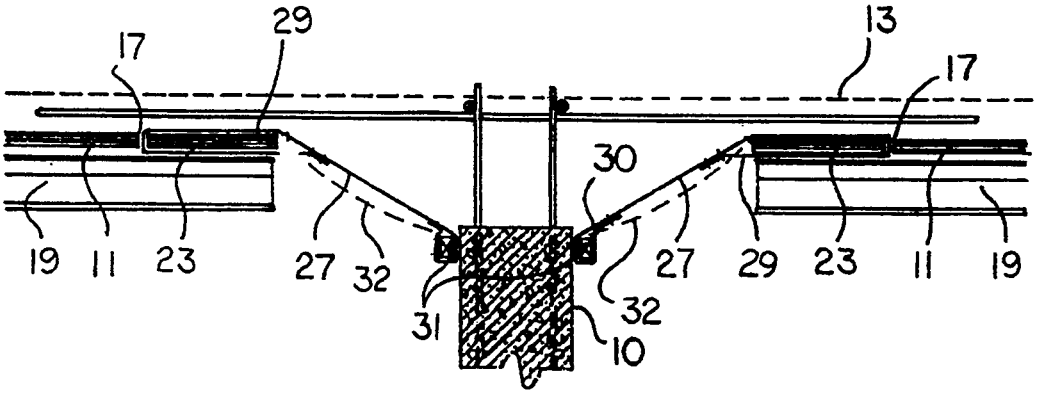
FIG. 3, is a transverse sectional view, taken through the formwork depicted in FIGS. 1 and 2.

FIG. 3, is a transverse sectional view, taken through the formwork depicted in FIGS. 1 and 2.

FIGS. 1 through 3, illustrate a formwork that can be used to form a frustum-shaped concrete capital connection, between a poured concrete slab and a pre-existing support column. In the drawings, the support column is referenced by numeral 10.

The concrete slab will be poured onto a panelized flat plate formwork deck structure 11, to a pre-determined depth. The upper surface of the poured concrete is indicated by numeral 13, in FIG. 3. The slab-column capital connection is formed as incident to the concrete slab pouring operation.

A flexible fabric sheet 27, is operatively installed on the panelized deck structure 11, so as to occupy an enlarged square opening 17, in the deck structure. The slab formwork deck structure is supported on horizontal joists or beams 19. Selected ones of these beams project beyond the edges of square opening 17, to provide support for formwork panels that are used to suspend the capital formwork sheet 17. Fabric sheet 27 is preferably impervious, or at least sufficiently non-porous to contain or support wet concrete.

The mold, or formwork, for the capital connection, comprises a rigid annular compression ring that includes two flat rectangular panels 21, extending parallel to one another, and two additional flat panels 23, extending crosswise of panels 21. End areas of the panels 21 and 23, are tied together by connection plates 25. The defined annular compression ring is sized to fit snugly within the square opening 17, in a deck structure 11, such that panels 21, and 23, are essentially coplanar with the panels of deck structure 11. In practice the panels 21 and 23 can be made of the same material as the panels of the deck structure, e.g. plywood.

The capital formwork comprises a flexible fabric sheet 27, having outer edge areas thereof attached to the flat compression ring. The inner edges of the flexible sheet are clamped or otherwise attached to vertical side surfaces of pre-existing support column 10. Flexible sheet 27, can be formed of various materials, e.g., woven high density polyethylene or polypropylene. Cost is a consideration in selection of the sheet material, since in many cases the sheet will be used only one time.

Sheet 27, is cut, folded, stitched, and mechanically, or adhesively, joined at selected points along its surface, to form a hollow frustum-shaped container for the poured concrete. Outer edge areas of the sheet 27, are turned back on themselves to form fabric loops 29. Rectangular panels 21 and 23, are extended through these loops 29, to provide a rigid frame for supporting the frustum-shaped sheet 27, from the deck structure 11.

The step of extending panels 21 and 23, through loops 29, is carried out prior to securement of the panels 21 and 23, into the ring configuration, by means of plates 25. After placement of the ring-sheet 27, assembly in deck opening 17, the inner (lower) edge areas of sheet 27, are secured to the side surfaces of column 10, by means of an annular collar or frame 31. For this purpose, inner edge areas of sheet 27, may be, formed into loops 30, or otherwise prepared for securement to a collar or frame 31, which serves to clamp the inner edge areas of sheet 27, to the side surfaces of column 10.

FIG. 3, shows the frustum-shaped sheet 27, in condition to receive the poured concrete. Depending on the elasticity and strength of the sheet material, the size of the capital, and the depth of the poured concrete slab, the sheet will experience some downward bulging due to the weight of the wet concrete, as indicated by dashed line 32, in FIG. 3.

The column capital formwork sheet 27, may be formed from multiple sheet elements sewn together, or from a unitary or single, flat fabric sheet. In the latter case, excess fabric will accumulate at the corners of the sheet. If the sectional depth of the capital being formed is sufficiently shallow, this excess fabric may be allowed to crease and fold naturally when the wet concrete is placed in the formwork. If the capital has a sufficiently greater sectional depth, the excess fabric may be gathered, furled, wired, or laced, in such a manner that the excess fabric will not interfere with the geometry and structural integrity of the fabric formwork. It will be appreciated that this method allows a single flat formwork sheet to be used in the casting of column capitals having a variety of sectional depths.

Figure 4:
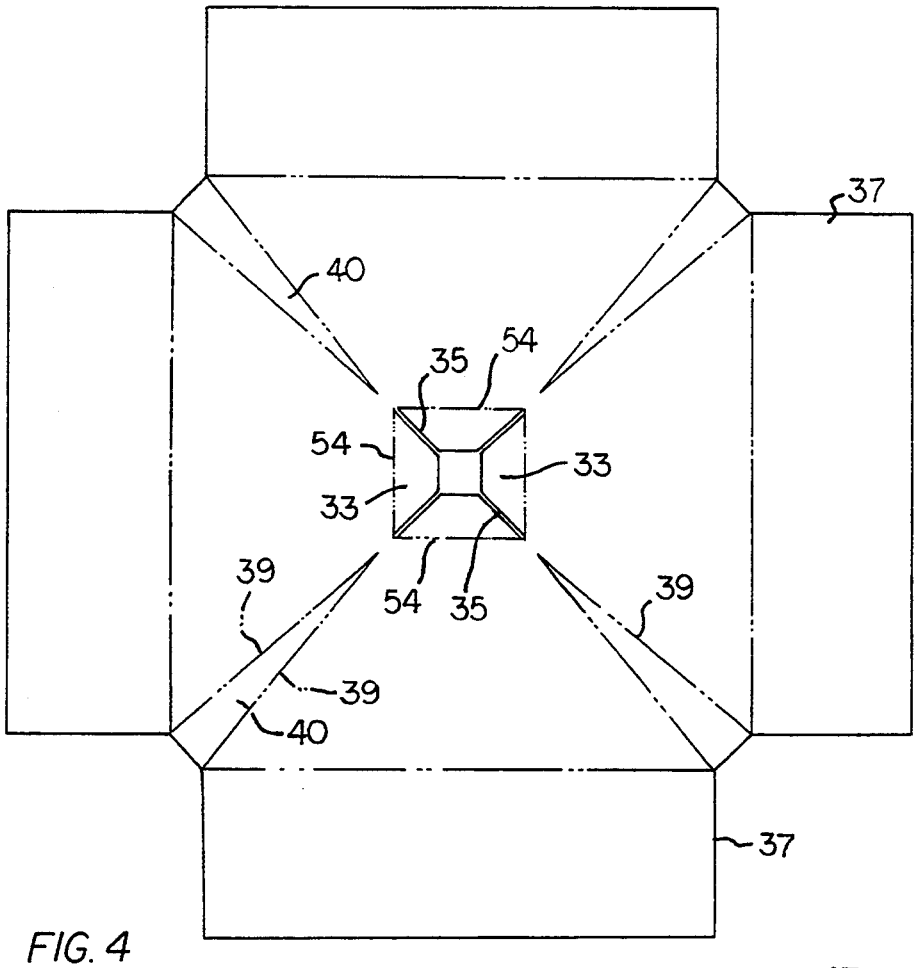
FIG. 4, is a plan view, of a flexible sheet that can be used in the formation of a formwork of the type depicted in FIG. 1.

FIG. 4, is a plan view, of a flexible sheet that can be used in the formation of a formwork of the type depicted in FIG. 1.

FIG. 4, shows one blank, or pattern, that can be used to form a fabric frustum-shaped container of the type depicted in FIGS. 1 through 3. A single sheet 27, has a central opening defined by the four foldlines 54 and four slits 35, that form the inner flap areas 33. Flap areas 33 can be used to form inner loops 30, or other attachment devices for attachment of sheet 27 to the outside faces of column 10. Flap areas 37, provide the material for outer loops 29. The single sheet is creased along the radial lines 39, and then sewn, mechanically or adhesively secured, along the radial crease lines 39 to form the flat side surfaces of the frustum; triangular sheet areas 40, constitute excess material extending from corner areas of the frustum-shaped container.

The fabric sheet formwork as depicted in FIG. 4, is used only one time. After the concrete has been poured and hardened, the fabric sheet material may be left in place, or stripped away from the undersurface of the concrete capital. The wooden frame 31, and compression ring are separated into their component parts for subsequent reuse in forming a new capital formwork assembly (using another frustum-shaped fabric sheet 27).

However, it would be possible to reuse the fabric sheet 27, by separating the sheet along one corner of the frustum, i.e., along one of the joints defined by crease lines 39. Various types of detachable connection devices could be used to detachably connect the side surfaces of the frustum at the separation line; e.g., laces, buckles, staples and various mechanical or adhesive devices (such as materials marketed under the tradename VELCRO, etc.).

Figure 6:
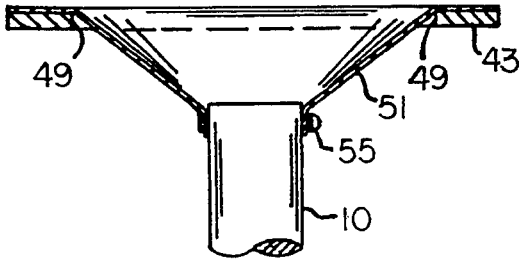
FIG. 6, is a sectional view, taken along line 6—6 in FIG. 5.
Figure 5:
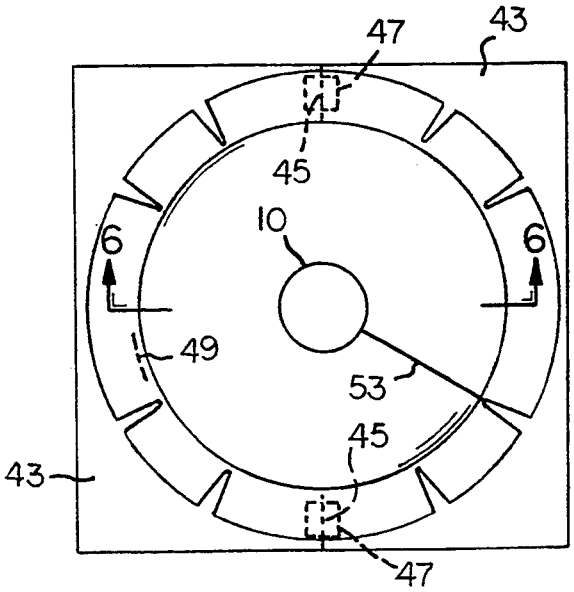
FIG. 5, is a top plan view, of another sheet-type formwork, that can be used in practice of the present invention.

FIGS. 1 through 3, illustrate the present invention used in conjunction with a concrete column having a square cross section. The frustum-shaped fabric container has a four-sided pyramidal configuration. FIGS. 5 and 6, illustrate the invention used in conjunction with a concrete column having a circular cross-section. The frustum-shaped container has a conical configuration.

FIG. 5, is a top plan view, of another sheet-type formwork, that can be used in practice of the present invention.

FIG. 6, is a sectional view taken along line 6—6, in FIG. 5.

FIG. 5, shows an annular compression ring formed by two flat panels 43, joined together along separation lines 45. The inner edge 49, of each panel 43, has an arcuate semi-circular contour in the top plan direction, such that the compression ring provides a circular edge support surface for the fabric sheet 51. Panels 43 are supported on deck support beams 19, (as in FIGS. 1 and 6), and are essentially coplanar with the panels of the previously described deck structure 11. In practice the compression panels 43 could be made of the same material as the panels of the deck structure 11, e.g. plywood.

Sheet 51, may be formed into a conical configuration from a single C-shaped sheet of material. Facing end edges of the sheet 51, are joined together along a radial seam line 53, to give the sheet 51, its conical, funnel-like shape. Tabs at the outer and inner edges of the sheet 51, provide attachment surfaces for joining the sheet 51, to the compression ring and the concrete column 10. When attached to the outside surface of a cylindrical column, a conventional web clamp 55, can be used to clamp inner edge (flap) areas of the fabric sheet 51, to the vertical side surfaces of the concrete column 10.

The construction depicted in FIGS. 5 and 6, will operate, or function, in essentially the same fashion as the structure depicted in FIGS. 1 through 3. The connection between the compression ring panels 43, and the outer edge flaps of sheet 51 shown in FIGS. 5 and 6 is a mechanical or an adhesive connection. The outer edge flaps may also be formed into hemmed loops as in the configuration illustrated in FIGS. 1, 2, and 3. If such hemmed loop connections are used in the FIG. 5 and 6 configuration, however, this would necessitate the use of a circular compression ring fitting into the slab formwork deck 11, in place of the rectangular compression ring illustrated in FIGS. 1, 2, and 3.

It will be appreciated that other column capital geometries may also be formed using the same principles as described above. The different column capital designs that can be formed by this method will be determined by the geometry of the compression ring, the location of the subjacent column connection, and the geometry and elasticity of the flexible formwork sheet employed in each case.

The present invention describes a Method of Forming a Concrete Column Capital in a Standard Flat Plate Concrete Slab. Features of the present invention are recited in the appended claims. The drawings contained herein necessarily depict structural features and embodiments of the Method of Forming a Concrete Column Capital in a Standard Flat Plate Concrete Slab, useful in the practice of the present invention.

However, it will be appreciated by those skilled in the arts pertaining thereto, that the present invention can be practiced in various alternate forms and configurations. Further, the previous detailed descriptions of the preferred embodiments of the present invention, are presented for purposes of clarity of understanding only, and no unnecessary limitations should be implied therefrom.

Finally, all appropriate mechanical and functional equivalents to the above, which may be obvious to those skilled in the arts pertaining thereto, are considered to be encompassed within the claims of the present invention.

What is claimed is:

1. A method of forming a concrete capital connecting a flat reinforced concrete slab with a pre-existing support column, comprising:

(a) providing a flat slab formwork deck that includes an opening directly above the pre-existing column;

(b) forming a flexible sheet into a hollow frustum configuration, in which the sheet has an outer edge area approximating the size of the deck opening and an inner edge area sized to fit around vertical side surfaces of the pre-existing column;

(c) forming a compression ring sized to fit snugly within the deck opening, and attaching said compression ring to outer edge areas of the flexible sheet;

(d) placing the compression ring and attached flexible sheet in the deck opening;

(e) clamping the inner edge area of the flexible sheet to side surfaces of the pre-existing column; and (f) pouring wet concrete onto the flat slab formwork and said flexible sheet so as to form a flat slab and column capital connected to the support column.

2. The method, as described in claim 1, wherein step (b) is performed with a single flat sheet.

3. The method, as described in claim 1, wherein step (b) involves the sub-step of tailoring the flexible sheet in such a manner that a reattachable joint is provided along a line between the outside surface of the column and the edge of the deck opening, thus producing a formwork capable of being removed from the finished concrete member and reassembled and reused to form another such concrete member.

4. A method of forming a concrete capital connecting a flat reinforced concrete slab with a pre-existing support column, comprising:

(a) providing a flat slab formwork deck that includes an opening directly above the column;

(b) forming a compression ring by connecting rigid ring components into an annular ring configuration;

(c) attaching a flexible sheet to said compression ring by securing edge areas of said sheet to said ring components;

(d) installing said compression ring in the deck opening, and attaching inner edge areas of said sheet to vertical side surfaces of the column so that the sheet is supported soley by its attachment to the compression ring and column; and (e) pouring wet concrete onto said flat slab formwork deck and said sheet, so as to form a concrete flat slab and column capital connected to the support column.

5. The method as described in claim 4, wherein steps (a) and (b) are carried out with deck and ring materials having the same vertical thickness, such that the compression ring is coplanar with the formwork deck.

6. The method as described in claim 4, wherein step (c) involves the sub-steps of providing a hemmed loop around the outer edges of the flexible sheet, and inserting the rigid ring components into the hemmed loop so that the loop connects the flexible sheet to the compression ring.

7. The method as described in claim 6, wherein step (d) is carried out so that the compression ring is coplanar with the formwork deck.

8. The method as described in claim 4, wherein step (c) comprises the sub-steps of forming the flexible sheet with four straight outer edges, and providing a loop along each outer edge of the sheet; step (b) comprising the sub-steps of inserting rigid panels into said loops, and then connecting the rigid panels together to form a rectangular compression ring.

9. The method as described in claim 8, wherein the flexible sheet is configured so that the installed sheet has a hollow frustum configuration.

* * * * *